US011319117B2

(12) United States Patent
Spyropoulos et al.

(10) Patent No.: US 11,319,117 B2
(45) Date of Patent: May 3, 2022

(54) DEVICE FOR AERATING A BEVERAGE

(71) Applicant: ORORA PACKAGING AUSTRALIA PTY LTD, Hawthorn (AU)

(72) Inventors: Mike Spyropoulos, Hawthorn (AU); Niall Dudman, Hawthorn (AU); Michael Draper, Hawthorn (AU); Matthew Weichard, Hawthorn (AU); Andrew Bousejean, Hawthorn (AU)

(73) Assignee: ORORA PACKAGING AUSTRALIA PTY LTD, Hawthorn (AU)

( * ) Notice: Subject to any disclaimer, the term of this patent is extended or adjusted under 35 U.S.C. 154(b) by 279 days.

(21) Appl. No.: 15/755,904

(22) PCT Filed: Aug. 31, 2016

(86) PCT No.: PCT/AU2016/050818
§ 371 (c)(1),
(2) Date: Feb. 27, 2018

(87) PCT Pub. No.: WO2017/035588
PCT Pub. Date: Mar. 9, 2017

(65) Prior Publication Data

US 2018/0339813 A1 Nov. 29, 2018

(30) Foreign Application Priority Data

Aug. 31, 2015 (AU) ..... 2015903522

(51) Int. Cl.
*B65D 25/48* (2006.01)
*B01F 5/06* (2006.01)
*B65D 39/14* (2006.01)

(52) U.S. Cl.
CPC ..... *B65D 39/14* (2013.01); *B01F 5/0644* (2013.01); *B65D 25/48* (2013.01); *B01F 2215/0072* (2013.01)

(58) Field of Classification Search
CPC ..... B01F 2215/0072; B01F 3/0446; B01F 5/0428; B01F 5/0644; B65D 25/48; B65D 39/14
USPC ..... 215/247
See application file for complete search history.

(56) References Cited

U.S. PATENT DOCUMENTS

| | | | | |
|---|---|---|---|---|
| 8,602,235 | B2 | 12/2013 | Meager | |
| 10,258,938 | B2 * | 4/2019 | Gaeta | B01F 5/0669 |
| 2010/0091605 | A1 | 4/2010 | Rasmussen et al. | |
| 2011/0186535 | A1 * | 8/2011 | Meager | B65D 25/40 215/40 |
| 2012/0074092 | A1 | 3/2012 | Devoy et al. | |
| 2012/0261844 | A1 * | 10/2012 | Lei | B01F 3/04751 261/119.1 |

(Continued)

OTHER PUBLICATIONS

International Search Report and Written Opinion of the International Searching Authority for corresponding International Patent Application No. PCT/AU2016/050818 dated Oct. 14, 2016, 10 pages.

*Primary Examiner* — Anthony D Stashick
*Assistant Examiner* — L Kmet
(74) *Attorney, Agent, or Firm* — Merchant & Gould P.C.

(57) ABSTRACT

The present invention relates to a device for aerating a beverage, such a wine, whilst being poured from a bottle. The present invention also relates to a bottle including a device and a method of bottling a beverage.

19 Claims, 5 Drawing Sheets

(56) References Cited

U.S. PATENT DOCUMENTS

2013/0202757 A1* 8/2013 Hawkins ..... B01F 13/002
426/474

* cited by examiner

DEVICE FOR AERATING A BEVERAGE

This application is a National Stage Application of PCT/AU2016/050818, filed 31 Aug. 2016, which claims benefit of Serial No. 2015903522, filed 31 Aug. 2015 in Australia, and which applications are incorporated herein by reference. To the extent appropriate, a claim of priority is made to each of the above disclosed applications.

FIELD OF THE INVENTION

The present invention relates to a device for aerating a beverage, such a wine, whilst being poured from a bottle. The present invention also relates to a bottle including a device for aerating a beverage while being poured from the bottle and a method of bottling a beverage.

BACKGROUND OF THE INVENTION

One parameter that has an impact on the taste of beverages, especially grape wine is the level of aeration of the wine. As wine is generally stored on gas tight bottles and is often opened before consumption to allow the bottle to "breath" and allow unwanted volatiles in the wine to reaction with oxygen in air shortly before consumption. Aeration is also thought to 'soften' and improve the flavour profile of the wine. To increase the level of aeration before consumption, wine is often poured into decanters and allowed to sit for a period. Decanters are essentially flasks or vessels having a large cross-section at a liquid level up to 1000 ml, such that the upper surface of the wine has a relatively large surface area exposed to air compared to the wine contain in a normal wine bottle.

In addition, the act of pouring the wine from the bottle into a decanter and down the wall of a decanter can also increase the level of aeration of the wine. However, a decanter is generally only used while dinning at home as it is unusual for restaurateurs to decanter wine from a bottle that has been purchased by a patron.

SUMMARY OF THE PRESENT INVENTION

One embodiment of the present invention relates to a device that can be installed in the neck of a bottle, the device includes an elongate body having:

- a wall formation extending longitudinally between opposite ends of the device,
- multiple passageways defined at least in part by the wall formation, the passageways extend in a direction between ends of the device, and when located in the neck of a bottle and beverage poured from the bottle, the passageways convey the beverage outwardly and air into the bottle which increases the surface area of the beverage in contact with the air;
- wherein the body is adapted so as to be equally operable with either end of the device being oriented toward an opening of the bottle.

A possible benefit of the device is that it can increase agitation of the beverage and thus in turn contact with air as the beverage is being poured from the bottle.

An adaptation of the body that may allow either end of the device to be oriented toward the bottle opening, may include for example, an outer profile of the body is constant along the length of the device. In other words, the outer profile about a longitudinal axis of the device may be symmetrical. Similarly, the outer profile of either end of the body of the device is the same.

Another adaptation of the body may be that each passageway essentially has a constant cross-section along the length of the respective passageway, so that resistance to flow of beverage along the passageway is essentially constant irrespective of the direction of flow through the passageways. In other words, the cross-sectional area of the different passageways may differ from one to another, but the cross-sectional area along each passageway is ideally constant along its particular length.

In an embodiment, the wall formation defines a cross-section transverse to a longitudinal direction of the body, hereinafter referred to as "the transverse cross-section", and the wall formation can move resiliently inwardly to reduce the transverse cross-section of the body to allow the body to be accommodated in a bottle neck. Ideally, the transverse cross-section can be accommodated in bottle necks of different sizes.

In an embodiment, the transverse cross-section of the body can be reduced along the entire length of the device to allow the device to be inserted into the bottle neck.

For example, a diameter of the transverse cross-section may be reduced in the range up to 15 mm, suitably in the range of 5 to 12 mm, and ideally approximately to 5 to 9 mm and even more suitably approximately 6 to 8 mm.

In one embodiment, the body may be have a diameter of approximately 24 to 25 mm when in a relaxed state, which can be reduced to approximately 14 to 16 mm during insertion of the device into the bottle neck. Once located in the bottle neck, the device can recoil or expand to meet and frictionally engage the internal face of the bottle neck. Ideally, the device is secured in an operative position by frictionally engaging the bottle device.

The wall formation may consist of a resiliently flexible material that allows the wall formation to move resiliently inwardly and toward each other to allow the transverse cross-section to be reduced by a compressive force applied radially to the body of the device.

The wall formation may consist of a resiliently compressible material that allows the wall formation to move resiliently inwardly and allow the transverse cross-section to be reduced by a compressive force applied radially to the body of the device.

Whilst it is possible that the body may have some passageways adapted for conveying beverages and other passageways adapted for conveying air into the bottle, ideally the passageways can convey both beverage out of the bottle and air into the bottle concurrently. For example, the passageways may have uniform cross-sections or areas so to be able to convey beverage and air equally. Therefore, each passageway can equally convey beverage or air depending on the manner in which the device is located in the bottle neck and the orientation of the bottle during pouring.

In an embodiment, the wall formation may be configured as a continuous wall about a perimeter of the body that has contours that extend lengthwise of the body.

In one embodiment, the wall formation may be tubular with contours that extend inwardly to provide the passageways for conveying beverage and air that are disposed to an inside and outside of the wall formation.

In one embodiment, the body of the device may consist of the wall formation only.

Ideally, the wall formation may include at least two outer wall sections that can move inwardly relative to each other. This feature assists in inserting the device in to the bottle. The outer wall sections may frictionally engage an inside surface of the bottle neck when installed in a bottle to secure the device in an operative position therein.

Ideally, the wall formation may include at least two inner wall sections that interconnect the outer wall sections. The inner wall sections may extend inwardly from the outer wall sections.

The outer wall sections may extend about an outer most perimeter of the body and are arranged so as to have gaps between the outer wall sections, and the gaps between the outer wall sections reduce when the transverse cross-section of the body is reduced.

The outer wall sections may be resiliently moveable toward each other to reduce the transverse cross-section of the body by means of the inner wall sections including resiliently flexible bridging formations that interconnect adjacent outer wall sections. The bridging formations are ideally resiliently bendable or flexible to allow the outer wall sections to move relative to each other.

The flexibility of the bridging formations may be provided by the bridging formation including two or more pairs of legs, in which each leg of the pairs of legs is connected to adjacent outer wall sections, and the legs are resiliently moveable toward or away from each other which in turn allows the outer wall sections to move inwardly and outwardly respectively. In other words, the legs of each pair of legs straddles the gap between outer wall sections that are adjacently located and the gaps between the outer wall sections reduces as the spacing between the legs of the pairs of legs reduces and the cross-section of the body also reduces.

The legs of the pair of legs may be interconnected by a joining section that is located at a spacing from a central axis of the body of the device.

The outer wall sections may be resiliently moveable to reduce the transverse cross-section of the body by means of the inner wall sections including a compressible material section that allows the outer wall section to move.

The passageways for conveying the beverage and air may include at least the following.

i) At least one first passageway disposed outwardly of the wall formation between the pairs of the legs.

ii) At least one second passageway disposed inwardly of the wall formation formed between adjacent legs of two adjacent of the pairs of legs.

iii) A third passageway that is centrally located of the body, and example, is located inwardly of the pairs of legs.

In one embodiment, the inner wall sections may extend at least half the length of the body of the device so that the passageways also extend at least half the length of the body of the device.

In another embodiment, the inner wall sections may extend the entire length of the device. The wall formation may extend the entire length of the device.

The body may be from 20 to 50 mm in length, and even more suitably approximately 30 to 45 mm, and even more suitably approximately 38 mm in length. The body may also have a length that approximates the size of a traditional cork, with a length of 50 to 40 mm and compressible to a diameter of approximately 15 to 16 mm for insertion into the bottle neck 22. Ideally, the length of the device is substantially incompressible compared to the diameter of the device 10.

The passageways may be linear conduits, i.e., without corners, bends and so forth. Although corners and bends on the passageways may help to increase turbulence in the beverage as it is poured, corners and bends can also restrict the rate at which a beverage can be poured from the bottle, whereas straight or curvilinear passageways will have little impact on the flow rate of the beverage from the bottle provided the passageways are not too small. In one embodiment, the passageways may include spiral passageways that are, for example, disposed to an outside of the wall formation. Some spiral passageways may also be disposed to the inside of the wall formation.

The device may include 3 or more outer wall sections, and ideally 4 or 5 outer wall sections that extend about the perimeter of the device.

Although it is possible that the body may comprise two or more pieces that are fitted together. Ideally the body, including the outer wall sections and the inner wall sections, are integrally formed. For example, the body may be extrusion moulded.

The body of the device may be made from any resilient material, including a polymeric material or metal. Other examples of resilient materials include: foams, rubbers and plastics having thermoplastic or elastomeric properties, such as thermoplastic elastomers (TPE) and ethylene vinyl acetate (EVA).

For instance, the body may be made from polyethylene and other suitable examples include high density polyethylene, low density polyethylene, linear low density polyethylene, polypropylene homopolymer, polypropylene copolymer and other polyolefins, polyethylene terephthalate, polyethylene vinyl acetate, thermoplastic elastomer, synthetic rubbers such as styrene-butadiene rubber (SBR) and nitrile rubber.

The body may also include a tacking agent to increase friction between the device and the bottle neck, and in turn assist in preventing the device from dislodging and sliding from an operative position in the neck of the bottle. Ideally, the tacking agent has a glass transition temperature above 35 degrees Celsius. An example of a tacking agent is plastomer.

In one embodiment, the body may include an outer layer that extends about the wall formation, in which the outer layer is made from a resiliently compressible material. The thickness of the outer layer may be compressed to accommodate the device in the bottle neck.

In one embodiment, the wall formation may include two materials having different compressibility or flexibility, namely a first compressible material and a second stiff material. The second compressible material may be a layered on the outside of the stiffer material structure that has been located thereon using any suitable means including co-extrusion, over moulding and so forth.

The property of the wall formation may be resiliently compressible which is provided together with, or independently of, the inner walls being resiliently flexible.

In an embodiment, the wall formation of the body may have an inner region defining the passageways that is made of rigid material, and an outer layer that is made of resiliently compressible material.

In another embodiment, the wall formation of the body may be provided by a continuous homogeneous material over the transverse cross-section and length of the device, save of the passageways extending through the body.

The passageways may have a uniform cross-section from end of the body to another end of the body.

The transverse cross-section may be uniform along the length of the body of the device prior to being installed in the neck of a bottle. The device may also have a uniform transverse cross-section after being installed in a bottle, or the outer wall sections may adapt to the inside cross-section of the neck of the bottle. For instance, the cross-section of the neck of the bottle may increase in a direction away from the opening of the bottle neck and the outer wall sections may have sufficient moveability to adopt to the inside wall of the bottle neck.

The present invention also relates to a bottle including the device having any one or a combination of the features described herein.

The bottle may also include an inwardly extending constriction that defines a smaller cross-section or diameter than the cross-section or diameter of the bottle neck in which the device is accommodated. The constriction can provide a stop against which the device engages, preventing the device from moving from the bottle neck into the main body of the bottle neck. In the situation in which the bottle is closed with a closure in the form of screw cap lid, the device may be located in the upper section of the bottle neck so that one end of the device is adjacent to the opening of the bottle. In the situation in which the bottle is closed with a closure in the form a cork located in the bottle neck, the device can be located in the bottle neck at a spacing from the top of the bottle so that the cork can be located in the spacing.

The device can be installed in the bottle after the bottle has been filled with the beverage and before the closure has been fitted to the bottle. The device can also be installed after the closure has been removed from the bottle, for example by the consumer or restaurateur.

Although the device may be tightly fitted in the bottle and not removed, in one embodiment, the device can be removed from the bottle neck. The device may be removed from the bottle using any suitable means, for example, via a tab extending the device that can be gripped and pulled.

The present invention also relates to a method of bottling a beverage, the method including the following steps:

i) filling a bottle with a beverage;

ii) inserting into the neck of the bottle the device for aerating the beverage when poured from the bottle, the device including any one or more of the feature of the device described herein; and iii) fitting a cap into the bottle to seal the bottle.

The step of inserting the device into the neck of the bottle can be carried out using a traditional cork installation device. The cork installation device may include a hopper in which a batch of the devices randomly supplied.

The step of inserting the device into the neck of the bottle can be carried out with either end of the opposite ends of the device being oriented into the opening of the bottle.

The step of inserting the device into the neck of the bottle includes compressing the device to a smaller diameter and releasing the device in the bottle so that the device is secured in an operative position in the bottle neck by engaging the neck of the bottle, and suitably frictionally engaging the bottle.

The step of inserting the device into the neck of the bottle may include compressing the device to a diameter of less than 20 mm, and ideally to a diameter in the range of the 12 to 16 mm.

The device can be inserted so as to be located below an opening of the bottle.

The device may be inserted so as to be located flush or level with an opening of the bottle. Alternatively, the device may be inserted up to 5 mm below the opening, or even more suitably in the range of 2 to 3 mm below the opening.

The step of fitting the cap onto the bottle can include a cap blank being rolled onto the thread of bottle neck.

The step of fitting the cap onto the bottle can also include the cap be rammed or screw threated onto the bottle neck.

An embodiment relates to a device that can be installed in the neck of a bottle, the device includes a body having:

an outer wall extending longitudinally of the body;

an inner region extending from the outer wall that define multiple passageways between ends of the device, and when located in the neck of a bottle, beverage can be poured from the bottle via the passageways which increases the surface area of the beverage in contact with the air compared to the beverage being poured from the bottle neck without the device, wherein the body is adapted so as to be equally operable with either end of the device being oriented toward an opening of the bottle.

Another embodiment relates to a device that can be installed in the neck of a bottle, the device including a body having:

an outer wall extending in a length direct of the body and defining a cross-section in a width-wise direction of the body, and wherein the outer wall can move resiliently inwardly to reduce the cross-section to allow the body to be accommodated in bottle necks of different sizes; and an inner region located inwardly of the outer wall to define multiple passageways in the cross-section of the body, the inner region extending at least part way along the length of device, and when located in the neck of a bottle, beverage can be poured from the bottle via the passageways which increases the surface area of the beverage in contact with the air being poured compared to the beverage being poured from the bottle neck without the device.

BRIEF DESCRIPTION OF THE FIGURES

The present invention will now be described with reference to the accompanying drawings, of which.

DETAILED DESCRIPTION

Figure 1:
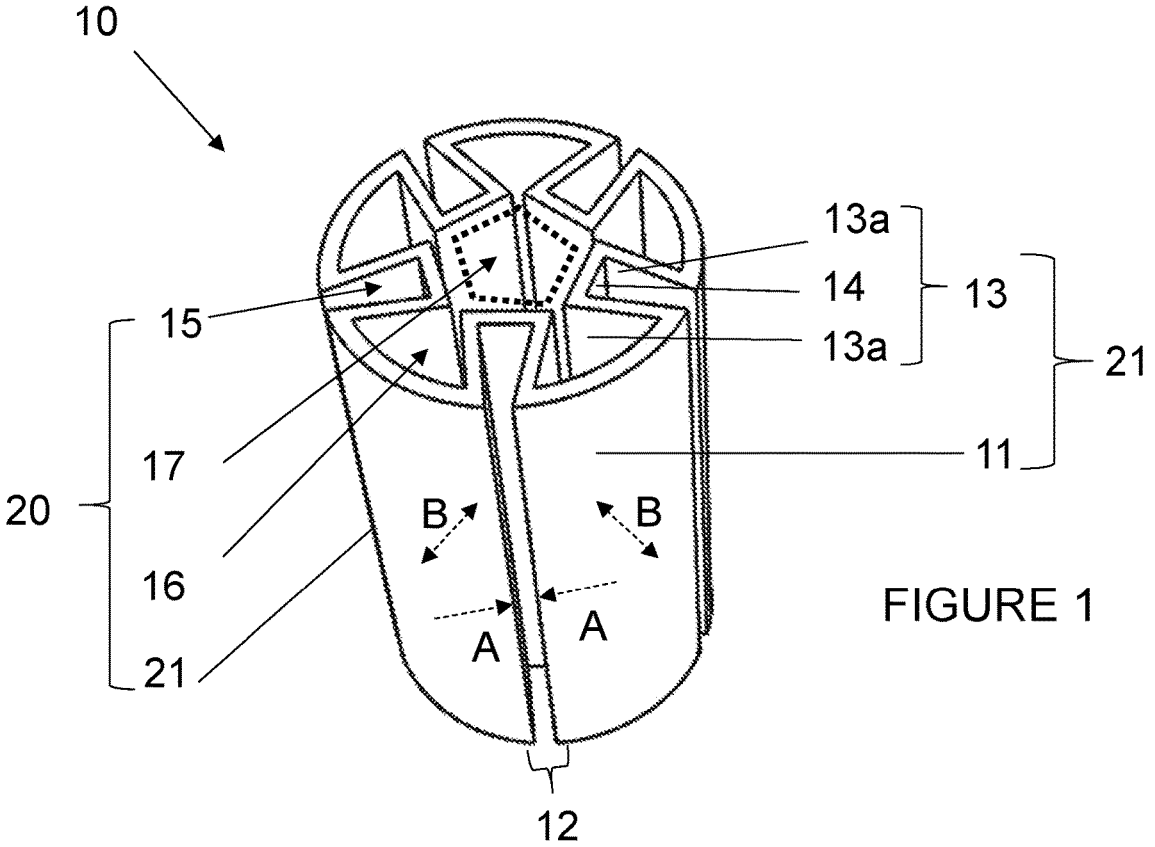
FIG. 1 is a perspective view of a device according to one embodiment for aerating a beverage as the beverage is being poured from the bottle.

Embodiments of the invention will now be described with reference to the accompanying drawings. Reference numerals have also been used in the description to help identify the features in the drawings and the same reference numerals have been used to identify the same or substantially the same features of the embodiments. However in order to maintain the clarity of the figures, the figures may not include all of the reference numerals in every instance.

The embodiments shown in FIGS. 1, 2, 3 and 5 are of a device 10 have a tubular body that can be installed in the neck of a conventional wine bottle for aerating the wine as it is being poured from the bottle. The body 20 of the device 10 has a tubular wall formation 21 that is contoured so as to provide passageways 15, 16 and 17 extending along the length of the device 10. The wall formation 21 includes five outer wall sections 11 that are equally sized and spaced about the perimeter of the device 10, the wall sections 11 are separated by gaps 12. Ideally, the outer wall sections 11 extend the entire length of the body and have a shaped outer profile having a convex or arc face that ideally matches the curvature of the inside of a bottle neck.

Figure 2:
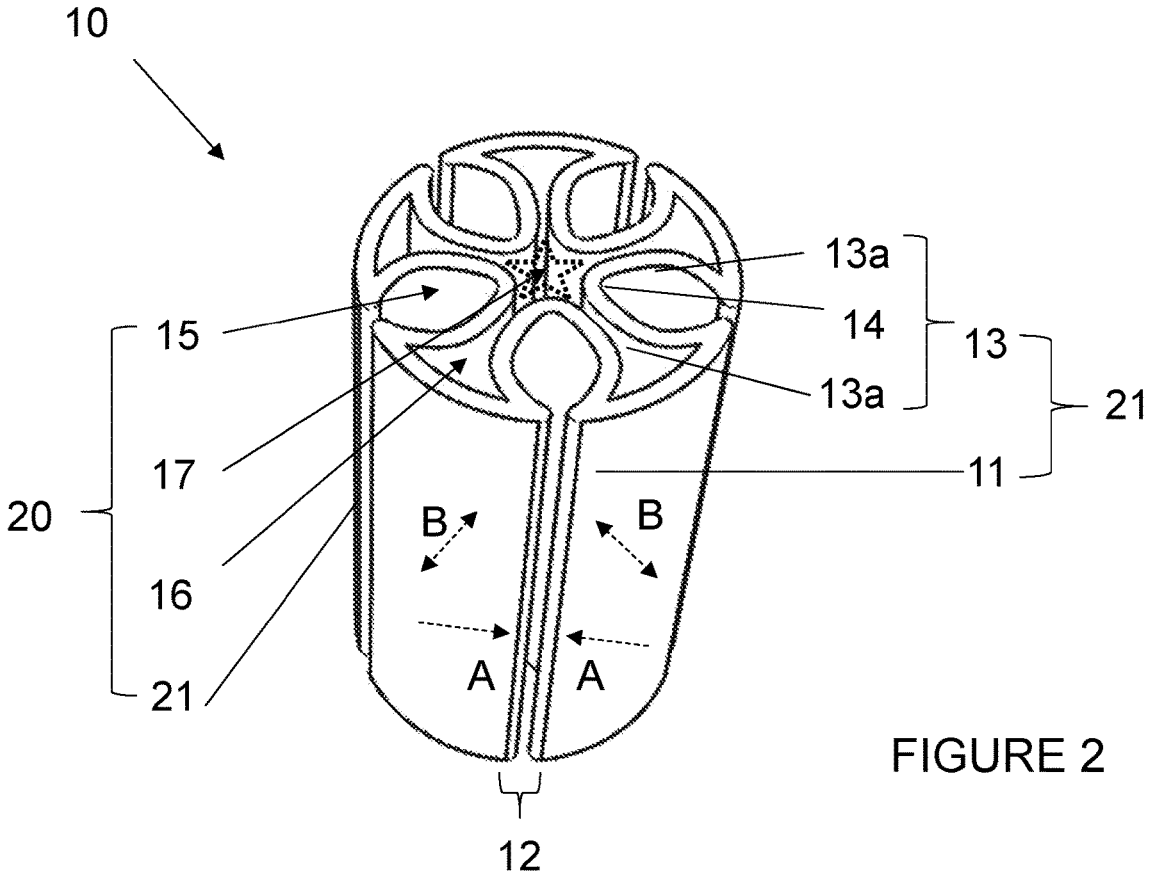
FIG. 2 is a perspective view of a device according to another embodiment for aerating a beverage as the beverage is being poured from the bottle.

As can be seen in FIGS. 1 and 2, the outer wall sections 11 define a transverse cross-section across the width of the device 10 that is perpendicular to the length of the device 10. The transverse cross-section of the device 10 can be reduced by compression to allow the body to be accommodated in bottle necks of different sizes, or in bottle necks having a tapering internal bore.

Ideally, the outer wall sections 11 can move resiliently inwardly by the wall sections 11 moving in the direction of the arrows B (see FIGS. 1 to 6), which causes the gaps 12 to reduce in the directions of arrows A between the outer wall sections 11. By reducing the gaps 12 between the outer wall sections 11, the transverse cross-section of the device 10 reduces in the direction of arrows B which can allow the body to be accommodated in bottle necks.

Figure 3:
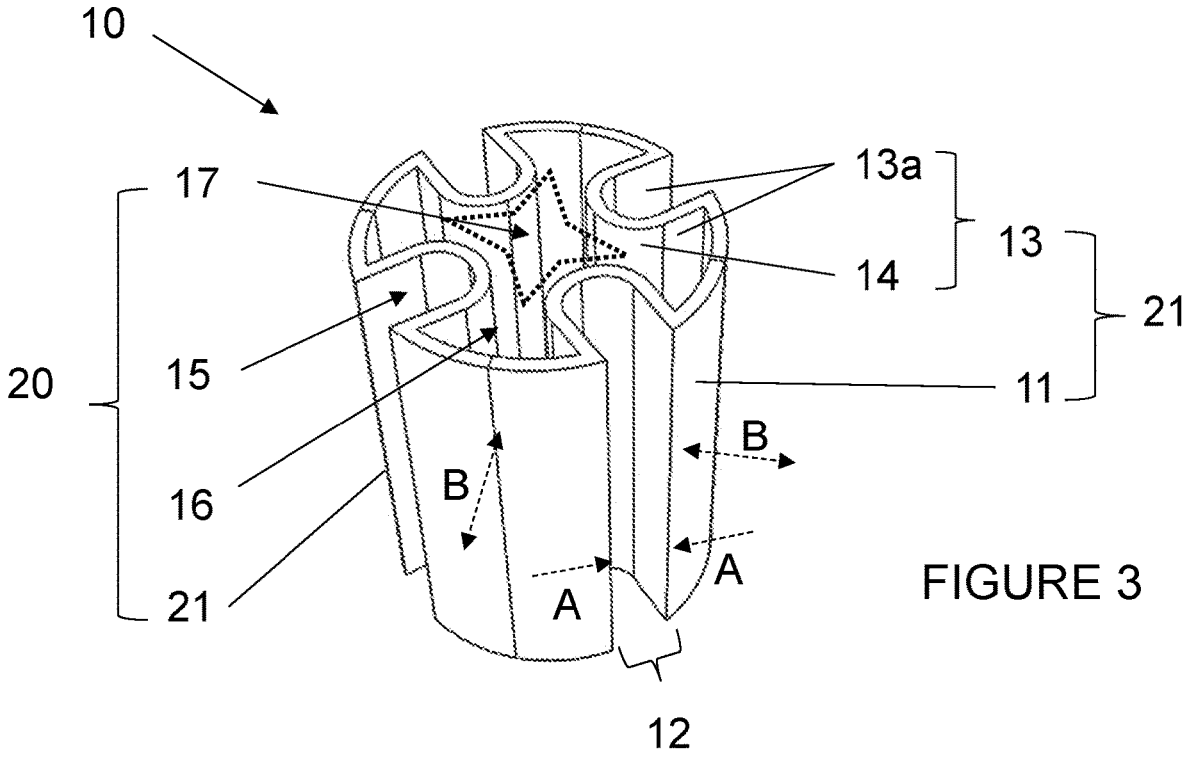
FIG. 3 is a perspective view of a device according to a preferred embodiment and FIG. 4 is a schematic representation of the device of FIG. 3 that is in the process of being inserting to the neck of the bottle.
Figure 5:
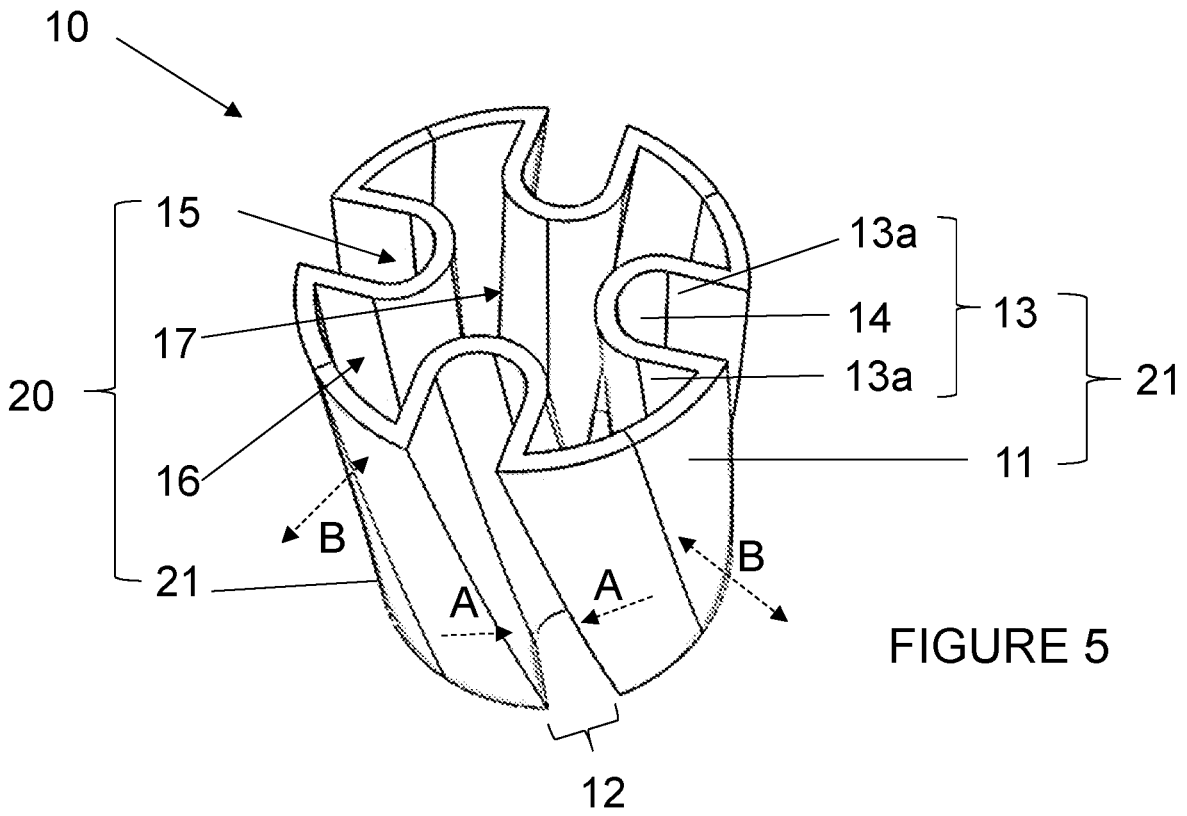
FIG. 5 is a perspective view of a device according to a preferred embodiment and FIG. 6 is a schematic representation of the device of FIG. 5 that is in the process of being inserting to the neck of the bottle.

The outer wall sections 11 are interconnected by inner wall sections 13 which are in the form of resiliently flexible bridging formations. The bridging formations are ideally in the form of pairs of legs 13*a*, in which the leg 13*a* of each pair is joined to an adjacent outer wall section 11. The legs 13*a* can move toward or away from each other, and when moved toward each other, the gaps 12 between the outer wall sections 11 will reduce in the direction of the arrows A. The legs 13*a* may be interconnected by a joining section 14 that faces toward a central axis of the body of the device 10. In the case of the FIG. 1, the legs 13*a* are essentially straight legs that extend from a linear joining section 14. In the case of FIG. 2, the legs 13*a* are curved legs that extend from an apex joining section 14. In the case of FIGS. 3 and 5, the legs 13*a* are essentially straight legs that extend from an arched shaped joining section 14.

In addition to allowing the outer wall sections 11 to move relative to each other, the inner wall sections 13 also divide the cross-section into longitudinal passageways 15, 16 and 17. Ideally the passageways 15, 16 and 17 extend along the entire length of the device 10.

Ideally, the device 10 is constructed from a resiliently flexible material that is food safe. Examples include low density polyethylene and nylon. The flexibility of the material allows the wall formation 21, such as the legs 13*a*, to flex relatively to each other and allow the transverse cross-section to be reduced during installation. It is also possible that the device 10 may be constructed from a compressible material that would allow, for example, the inner wall sections 13 to shorten on compression of device during installation.

In any event, the profile of the outer wall sections 11 is essentially constant such that for the purpose of installing the device 10 in a bottle, the device 10 can be installed into a bottle neck with either end of the device 10 facing out of the bottle. In other words, the orientation of the device 10 does not have an impact on installing the device 10 in the bottle neck, or on operation of the device 10.

Figure 4:
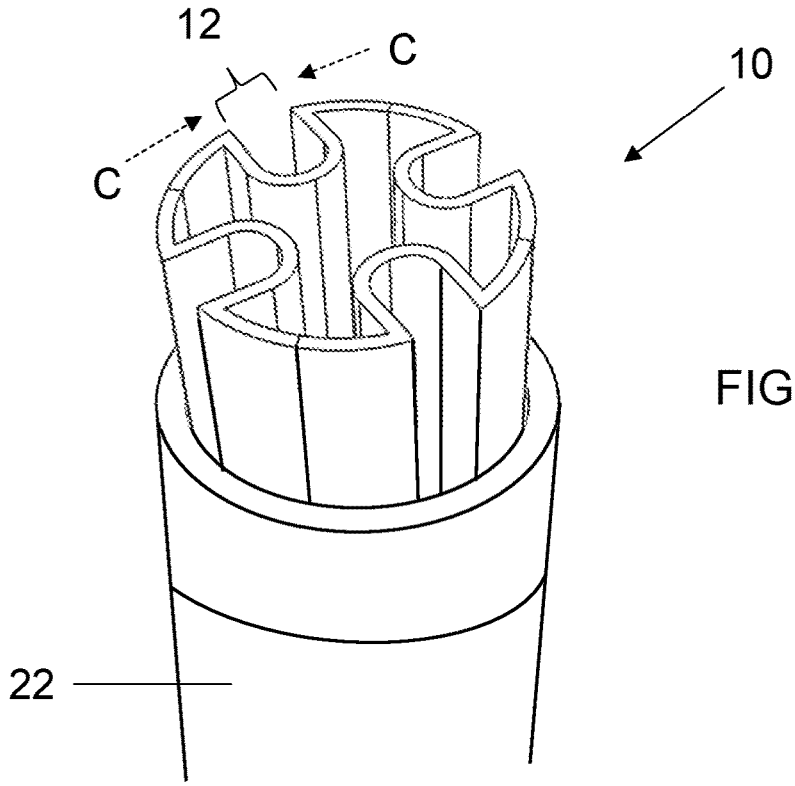
Figure 6:
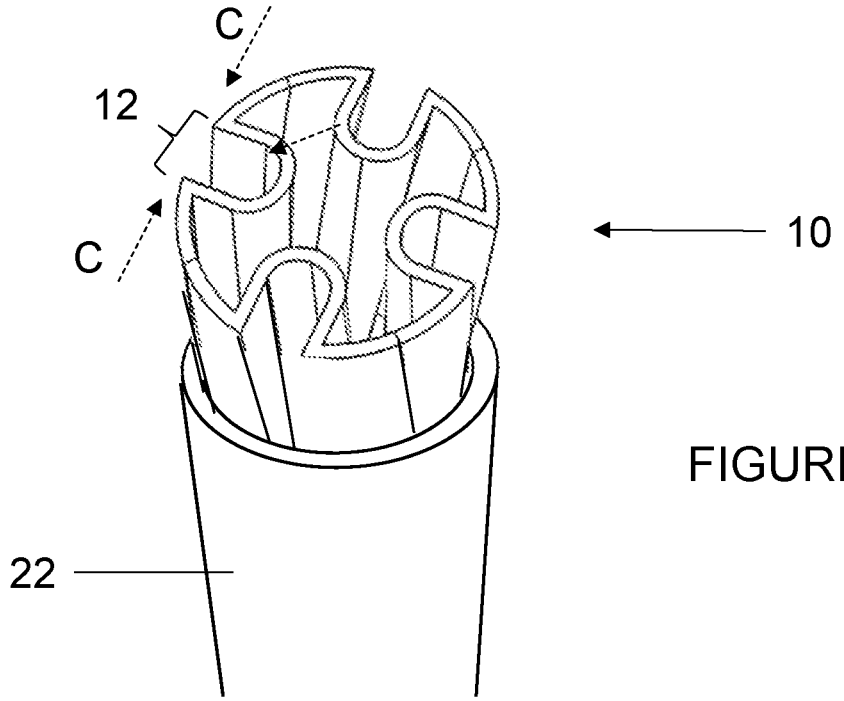

FIGS. 4 and 6 are photographs illustrating the device 10 partially inserted into a bottle neck. As can be seen by the arrows A, the gap 12 between the outer side walls 11 outside the bottle is greater than the gap 12 of the side wall inside the bottle. Moreover FIG. 3 illustrates the device 10 in a relaxed state, prior to installation and compression in which the legs 13*a* are essentially parallel, whereas FIG. 4 illustrates the legs 13*a* of the device in the process of being pressing toward each other in a direction indicated by arrows C so that the device 10 can be accommodated in the bottle neck. Similarly, FIG. 5 illustrates the device in a relaxed state, prior to installation and compression in which the legs 13*a* are essentially parallel, whereas FIG. 6 illustrates the legs 13*a* of the device 10 in the process of being pressing toward each other in a direction indicated by arrows C to reduce the transverse cross-section so that the device 10 can be accommodated in the bottle neck.

The device 10 is ideally the size of traditional sealing cork, namely approximately 38 mm in length, and compressible to a diameter of approximately 15 to 16 mm for insertion into the bottle neck 22. When in the bottle, ideally the device expands and is retained in position. In addition, when in the relaxed state the device may have diameter of approximately 23 to 25 mm.

FIGS. 1, 2, 3 and 5, illustrate the longitudinal passageways of the device in the form of:

i) five perimeter passageways 15 formed between the pairs of the legs 13*a* on an outside of the of the wall formation 21;

ii) five intermediate passageways 16 formed between legs 13*a* of two adjacent pairs of legs 13*a*, and the outer wall section 11 to which the adjacent legs 13*a* are attached; and iii) a centralised passageway 17 (shown in the figures in dotted outline) that is centrally located of the body that is defined by the joining sections 14 of the pairs of legs.

As can be seen, the intermediate and centralised passageways 16 and 17 are not sealed from each other and fluids, i.e., beverage and air, can pass between the passageways 16 and 17. The perimeter passageways 15 are formed on the outside of the wall formation between the legs 13*a*, and face the wall of the bottle neck through the gap 12.

FIGS. 1 to 4 illustrate linear passageways 15, 16 and 17 that extending the length of the device. In the case of the FIGS. 5 and 6, the passageways 15, 16 and 17 are curvilinear with the outer wall sections 11 and the inner wall section 13 also having a corresponding curvilinear shape. Passageways 15 and 16 of the embodiment shown in FIGS. 5 and 6 also have a spiral configuration. One of the features of the embodiment illustrated in FIGS. 5 and 6 is that as the beverage is conveyed along the passageways 15, 16 and 17 it flows in a tumbling or spiralling manner that further helps to agitate and mix the beverage and air.

The perimeter passageways 15 each have a constant cross-section along their length. The intermediate passageways 16 each have a constant cross-section along their length. The centralised passageways 17 may also have an essentially constant cross-section.

Figure 7:
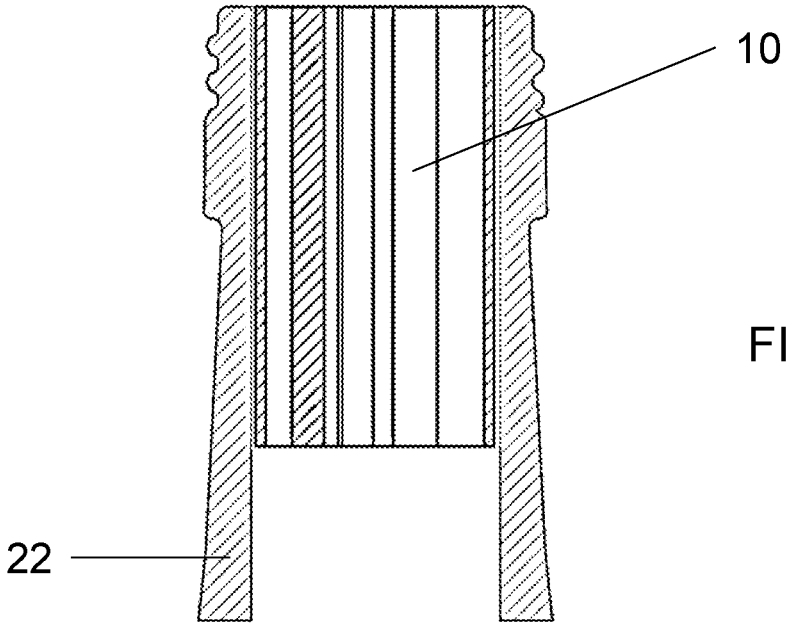
FIG. 7 is a cross-sectional view through a longitudinal axis of a conventional bottle neck in which the device of FIG. 3 is installed in the neck of a bottle.
Figure 8:
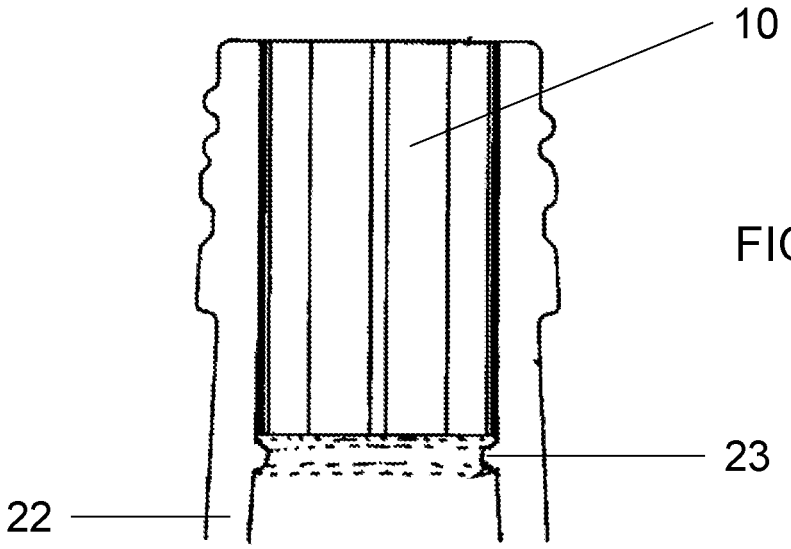
FIG. 8 is a cross-sectional view through the axis of a bottle neck according to an embodiment in which the device of FIG. 1 has been installed.

FIGS. 7 and 8 illustrate the device 10 installed in the bottle neck 22. The device 10 is configured to frictionally fit inside the bottle neck 22 and be retained in an operative position by means of the friction fit.

In the case of the FIG. 8, the bottle neck 22 includes a constriction 23 spaced from the opening of the bottle neck 22 so that the device 10 can be accommodated above the constriction 23. The constriction 23 helps to prevent that device 10 from inadvertently moving down the bottle neck 22 into the main body part of the bottle.

When in use, beverage can be poured from the bottle via the passageways 15, 16 and 17, and air can enter the bottle via the passageways 15, 16 and 17. There is no need for precision in terms of which passageways 15, 16 and 17 are used by the beverage and which passageways 15, 16 and 17 are used from venting air into the bottle.

Without wanting to be limited by theory, the passageways 15, 16 and 17 provide a means for splitting the flow of the beverage up into sub-streams which in turn increases the total surface area of the beverage in contact with air as the beverage flows through the device 10. The device 10 thereby has the effect of increasing the aeration of the wine as the wine is poured from the bottle compared to pouring the wine from the bottle without the device 10.

The layout and number of the passageways 15, 16 and 17 enables the flow rate of the wine from the bottle not to be significantly reduced compared to the flow rate from a bottle without the device. Hence consumers will not experience a disruption from the normal pouring characteristics.

When pouring a beverage from a conventional bottle, the beverage can make a "glugging" sound when exiting from the bottle. Without wanting to be limited by theory, it is believed that when the beverage exits the bottle, a vacuum is created in the bottle, and when atmospheric pressure acting on the beverage exceeds the weight of the beverage flowing, the discharge of beverage is temporarily interrupted as air enters the bottle, creating the glugging sounds and beverage hold-up in the bottle. A potential benefit of the device is that air can enter the bottle over shortened periods, providing greater opportunity for air and the beverage in hold-up to mix, prior to the beverage entering the passageways 15, 16 and 17.

The device 10 can be made of any suitable material, including polymeric materials. Examples of polymeric materials that are food grade, i.e., free of biphenol A compounds and allow the outer side walls to be moveable include but are by no means limited polyethylene, including high density polyethylene, low density polyethylene, linear low density polyethylene, polypropylene homopolymer, polypropylene copolymer and other polyolefins, polyethylene terephthalate, polyethylene vinyl acetate, thermoplastic elastomer, synthetic rubbers such as styrene-butadiene rubber (SBR) and nitrile rubber.

A benefit in using polymeric materials is that a tacking agent such as plastomer can be included to increase friction between the device and the inside of the bottle neck. Ideally the device can be held in an operative position solely by means of the friction fit as shown in FIG. 7.

Ideally, the device has an integrally formed construction and may be made, for example in an extrusion moulding process.

Some of the benefits of the embodiments include:

i) The device can work the same way if inserted in the bottle from either end. This is an important feature as the device can be installed into the bottle using an automated machine that picks up the devices from a hopper without ascertain whether the device is in the correct orientation for installation, i.e., upside down not.

ii) The device increase the surface of the wine exposed to air.

iii) The device is adapted to allow the device to be fitted to bottle necks of various sizes by means of the inner wall section acting like a spring, or the outer wall section being compressible.

iv) The device can be installing during a beverage bottling process by a traditional corking machine. Alternatively, the device can be installed by hand during bottling or after the bottle has been opened for consumption.

v) The device can reduce dripping of the beverage during the standard pouring process.

We have conducted trials involving pouring red wine from bottles that have been fitted with the device. After taking into account oxygenation of the wine after opening of the bottle due to exposure to air, we have found that the device can increase the oxygen content of the wine poured from the bottle by up to 14%, and typically in the range of 7 to 10%. The results were measured using a probe that measured oxygen content at concentrations of parts per million.

Figure 9:
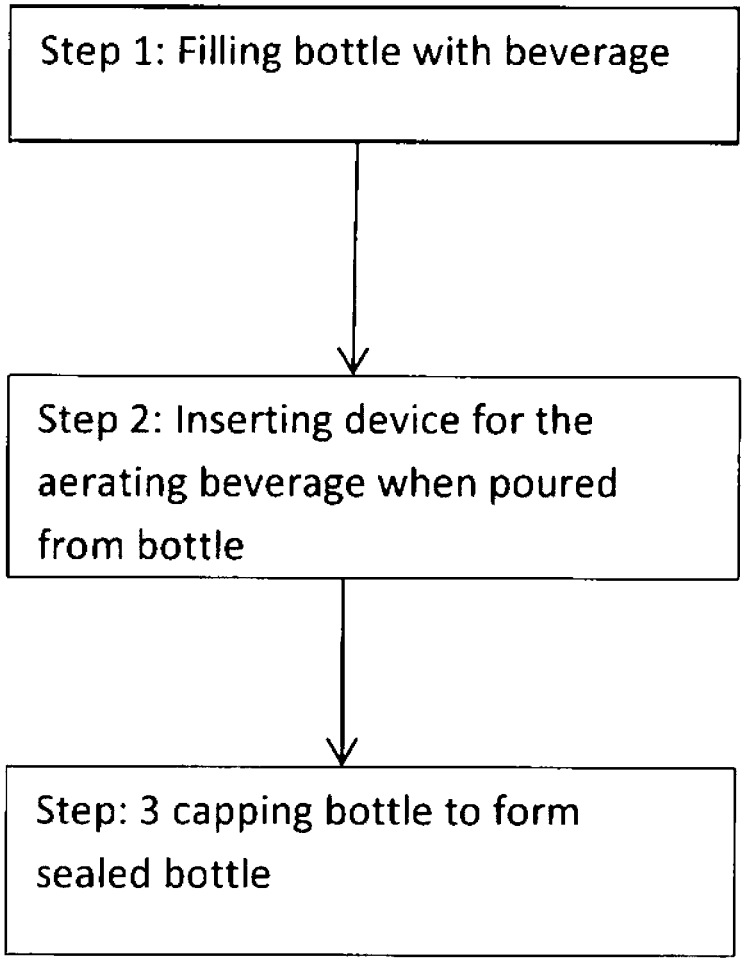
FIG. 9 is a block diagram illustrating the steps of a method for bottling a beverage.

FIG. 9 is a block diagram of the method for bottling beverage using the device described herein. As can be seen, the method includes filling a bottle with a beverage, and then inserting the device described herein into the bottle neck. The inserting the device can be performed using any suitable machinery, but is ideally performed using a convention cork insertion machine which compresses the device to a diameter in the range of the 14 to 16 mm during installation. Once the device has been installed, the bottle can be sealed using any suitable closure including a screw cap.

The method may also include a preliminary step during moulding of the bottle to increase the volume of the bottle to accommodate the volume of the device and allow sufficient headspace in the bottle. The preliminary step may include adjusting the punt bottle, namely the curved bottom surface of the bottle, to increase the volume of the bottle. According to a preferred embodiment, the device may have a volume of the 3.5 ml.

It will be understood to persons skilled in the art of the invention that many modifications may be made without departing from the spirit and scope of the invention.

Although not shown in the figures, it is also possible that the outer wall sections 11 may include a compressible material such as foams, rubbers and plastics having thermoplastic or elastomeric properties, such as thermoplastic elastomers (TPE) and ethylene vinyl acetate (EVA). The compressibility of the outer side wall may allow the device to be fitted into bottle necks of different sizes.

The invention claimed is:

1. A device that can be installed in the neck of a bottle, the device including:

an elongate body solely formed from a continuous perimetric wall formation that extends longitudinally between opposite ends of the device; and a plurality of passageways defined by the wall formation, the passageways extend in a direction between ends of the device, and when located in the neck of a bottle and beverage poured from the bottle, the passageways convey the beverage outwardly and air into the bottle which increases the surface area of the beverage in contact with the air;

wherein a profile of the body is constant along the length of the device so as to be equally operable with either end of the device being oriented toward an opening of the bottle, the profile configured to enable the wall formation to move inwardly to allow the body to be accommodated in bottle necks of different sizes; and wherein the plurality of passageways for fluid flow includes: (i) at least one outer passageway disposed outwardly of the wall formation; and (ii) a central passageway located along a central axis of the body.

2. The device according to claim 1, wherein each passageway has a constant cross-section along the length of the passageway, and resistance to flow of beverage along the passageway is constant irrespective of the direction of flow through the passageways.

3. The device according to claim 1, wherein the diameter of the cross-section can be reduced in the range up to 15 mm.

4. The device according to claim 1, wherein the device is secured in an operative position by frictionally engaging an inside of a neck of the bottle.

5. The device according to claim 1, wherein the wall formation consists of a resiliently flexible material that allows the wall formation to move resiliently inwardly and allow the transverse cross-section to be reduced by a compressive force applied radially to the body of the device.

6. The device according to claim 1, wherein the wall formation consists of a resiliently compressible material that allows the wall formation to move resiliently inwardly and allow the transverse cross-section to be reduced by a compressive force applied radially to the body of the device.

7. The device according to claim 1, wherein the passageways can convey both beverage out of the bottle and air into the bottle concurrently.

8. The device according to claim 1, wherein the wall formation includes contours that extend inwardly to provide the at least one outer passageway.

9. The device according to claim 1, wherein the wall formation includes at least two wall sections that can move inwardly relative to each other.

10. The device according to claim 9, wherein the wall sections are integrally formed with flexible bridging formations to allow the wall sections to resiliently move towards each other to reduce the transverse cross-section of the body.

11. The device according to claim 9, wherein the flexible bridging formations include a compressible material section that allows the wall sections to move relative to each other.

12. The device according to claim 10, wherein the plurality of passageways further includes at least one inner passageway disposed inwardly of the wall formation between adjacent bridging formations.

13. The device according to claim 1, wherein the body is extrusion moulded from a resilient polymeric material and wherein the polymeric material includes a tacking agent to assist in preventing the device from dislodging and sliding from an operative position in the neck of the bottle.

14. A bottle including the device according to claim 1.

15. A method of bottling a beverage, the method including the following steps:

i) filling a bottle with a beverage;

ii) inserting into the neck of the bottle the device according to claim 1; and iii) fitting a cap into the bottle to seal the bottle.

16. The method according to claim 14, wherein the step of inserting the device into the neck of the bottle can be carried out using a traditional cork installation device.

17. The method according to claim 14, wherein the step of inserting the device into the neck of the bottle is be carried out with either one of two opposite ends of the device being oriented into the opening of the bottle.

18. The method according to claim 17, wherein the step of inserting the device into the neck of the bottle includes compressing the device to a smaller diameter and releasing the device in the bottle so that the device is secured in an operative position in the bottle neck by frictionally engaging inner surfaces of the neck of the bottle.

19. The device according to claim 12, wherein the central and at least one inner passageways are not sealed from each other, such that fluid can pass therebetween.

* * * * *